US006074114A

United States Patent [19]

Ming et al.

[11] Patent Number: 6,074,114

[45] Date of Patent: Jun. 13, 2000

[54] COLOR PRINTER FOR REPETITIVELY PRINTING A DOCUMENT

[75] Inventors: Chien Chi Ming, Yungho; Shih Ming-Huang, Pan-Chiao, both of Taiwan

[73] Assignee: ACER Peripherals, Inc., Taoyuan, Taiwan

[21] Appl. No.: 09/005,557

[22] Filed: Jan. 12, 1998

[51] Int. Cl.[7] ..... B41J 13/26

[52] U.S. Cl. ..... 400/636; 400/711; 400/630

[58] Field of Search ..... 400/120.04, 630, 400/641, 708, 709, 711, 636; 271/227, 258.01; 347/174, 178, 218

[56] References Cited

U.S. PATENT DOCUMENTS

| | | | |
|---|---|---|---|
| 3,981,388 | 9/1976 | Guiliani | 400/711 |
| 4,130,884 | 12/1978 | Hildinger | 400/711 |
| 5,636,928 | 6/1997 | Shuna et al. | 400/636 |
| 5,743,663 | 4/1998 | Imai | 400/120.04 |

*Primary Examiner*—Christopher A. Bennett

[57] ABSTRACT

The present invention discloses a color printer and its printing method for accurately printing different colors on a document. The printer comprises two roller wheels for clamping and carrying the document forward and backward, a stepping motor for driving the two roller wheels, a detector for detecting a front edge of the document, a printing head for printing the document, and a control circuit for controlling operations of the printer. The control circuit comprises a memory for recording the number of steps of the stepping motor as printing position of the document. The printing method comprises the following steps: (1) using the stepping motor to carry the document forward and using the detector to detect the front edge of the document; (2) calculating the number of forward steps of the stepping motor after the front edge of the document is detected and using the printing head to print the document according to the calculated forward steps until one pass of the printing is finished; (3) carrying the document backward to move the front edge of the document away from the detector; and (4) repeating from step (1) to step (3) until all passes of the printing are finished.

11 Claims, 3 Drawing Sheets

COLOR PRINTER FOR REPETITIVELY PRINTING A DOCUMENT

BACKGROUND OF THE INVENTION

1. Field of the Invention

The present invention relates to a printer, and more particularly, to a color printer for repetitively printing a document.

2. Description of the Prior Art

Repetitive printing methods are commonly used by color printers in printing color documents. When printing a color document, a color printer will usually print one color in each printing pass and three passes are usually required for printing three different colors. Such repetitive printing methods require accurate printing position control so that different colors can be accurately printed to form a complete color document.

Please refer to FIG. 1. FIG. 1 is a structural diagram of part of a prior art printer 10. The printer 10 comprises two cylindrical roller wheels 12, a stepping motor 14, a detector 16, a printing head 18, a reduction gear 20, and a paper supplier 22. The two roller wheels 12 are rotatably positioned together and in contact with each other for clamping and carrying a document 24 supplied by the document supplier 22. The reduction gear 20 is installed between the stepping motor 14 and the two roller wheels 12 so that the stepping motor 44 can drive the two roller wheels 12 forward or backward through the reduction gear 20. The detector 16 is installed at one side of the two roller wheels 12 for detecting a front edge 26 of the document 24. The printing head 18 is installed at another side of the roller wheels 12 for printing the document 24 after the detector 16 detects the front edge 26 of the document 24.

Please refer to FIG. 2. FIG. 2 is a function block diagram of the printer 10 shown in FIG. 1. The printer 10 comprises a stepping motor 14, a detector 16, a printing head 18, and a control circuit 30 which has a memory 32. The control circuit 30 is connected to the stepping motor 14, detector 16 and printing head 18 for controlling operations of the printer 10. The memory 32 is used for recording the number of forward or backward steps of the stepping motor 14 for controlling the printing position of the document 24. When the detector 16 detects the front edge 26 of the document 24, it sends a signal to the control circuit 30 so that the control circuit 30 can set an initial printing position in the memory 32. The control circuit 30 then controls the printing head 18 and stepping motor 14 to initiate a color printing pass. When the first color printing pass is finished, the control circuit 30 will activate the stepping motor 14 to carry the document 24 backward the number of forward steps recorded in the memory 32, and then repeats the color printing pass until all the colors are printed.

The printing method of the prior art printer 10 in printing a color document can be summarized below:

a. activating the stepping motor 14 to carry the document 24 forward until the detector 16 detects the front edge 26 of the document 24;

b. setting an initial printing position in the memory 32;

c. activating the stepping motor 14 to carry the document 24 forward and using the printing head 18 to print the document 24; recording the number of forward steps in the memory 32 until the current printing pass is finished;

d. activating the stepping motor 14 to carry the document 24 backward the number of forward steps recorded in the memory 32;

e. repeating the above steps until all colors are printed.

One problem experienced in the prior art printer 10 is that when the document 24 is carried forward or backward by the two roller wheels 12, the frictional force between the document 24 and the printer 10 may drag the document 24 and thus cause small displacements between the document 24 and the two roller wheels 12. The small displacements will be accumulated in each printing pass which will make the printing position recorded in the memory 32 inaccurate. Such inaccuracy will cause the colors of the following printing passes printed in wrong places.

SUMMERY OF THE INVENTION

It is therefore an objective of the present invention to provide a printer which can solve the above mentioned problem.

In a preferred embodiment, the present invention provides a printing method used by a printer for printing a document, the printer comprising:

two cylindrical roller wheels rotatably positioned together and in contact with each other for clamping and carrying the document forward and backward;

a stepping motor for driving the two roller wheels forward and backward;

a detector installed at one side of the two roller wheels for detecting a front edge of the document;

a printing head installed at another side of the two roller wheels for printing the document; and a control circuit connected to the stepping motor, detector and printing head for controlling operations of the printer, the control circuit comprising a memory for recording the number of forward or backward steps of the stepping motor as printing position of the document;

the printing method comprising the following steps:

(1) using the stepping motor to carry the document forward and using the detector to detect the front edge of the document;

(2) calculating the number of forward steps of the stepping motor after the front edge of the document is detected and using the printing head to print the document according to the calculated forward steps until one pass of the printing is finished;

(3) carrying the document backward to move the front edge of the document away from the detector; and (4) repeating from the step (1) to the step (3) until all passes of the printing are finished.

It is an advantage of the present invention that the document is printed at each pass according to the forward steps calculated after the front edge of the document is detected. The small displacement accumulated in each printing pass has no effect at all for the following printing pass since the front edge of the document will be detected again at the following printing pass.

These and other objectives of the present invention will no doubt become obvious to those of ordinary skill in the art after reading the following detailed description of the preferred embodiment which is illustrated in the various figures and drawings.

DETAILED DESCRIPTION OF THE PREFERRED EMBODIMENT

Figure 2:
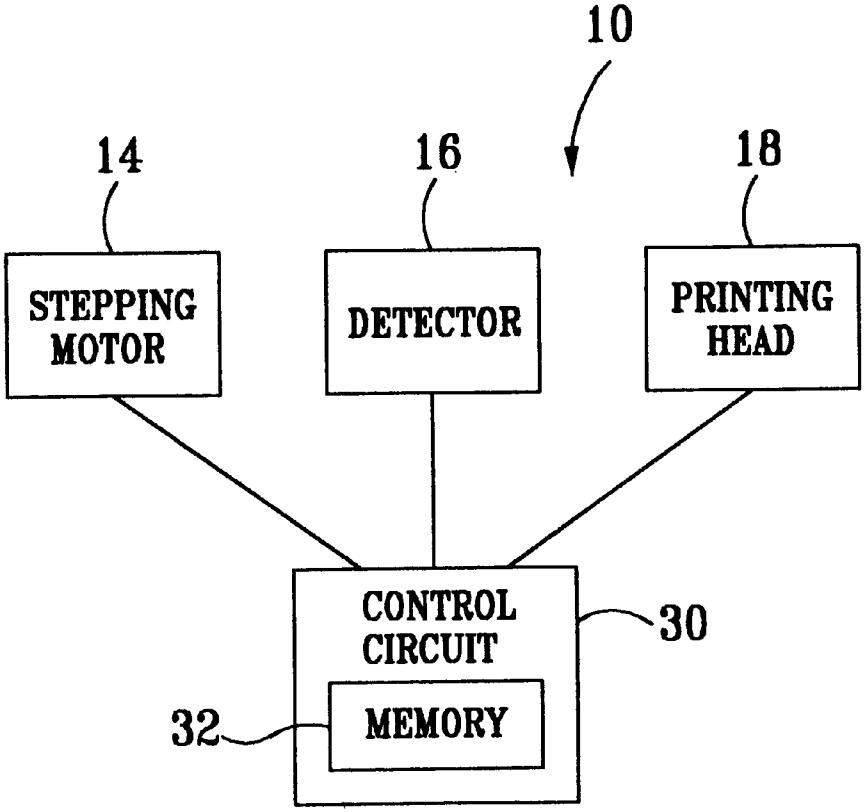
FIG. 2 is a function block diagram of the printer shown in FIG. 1.
Figure 1:
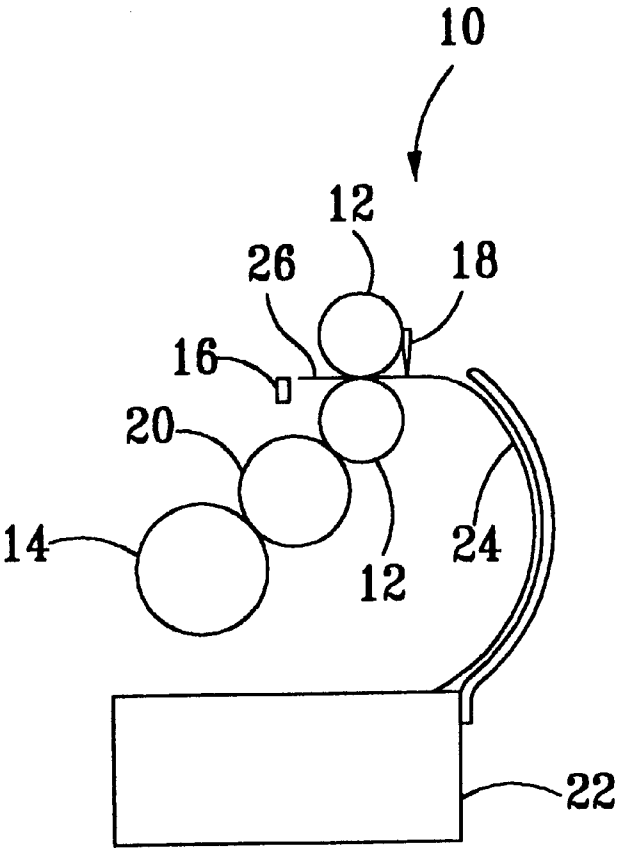
FIG. 1 is a structural diagram of part of a prior art color printer.
Figure 4:
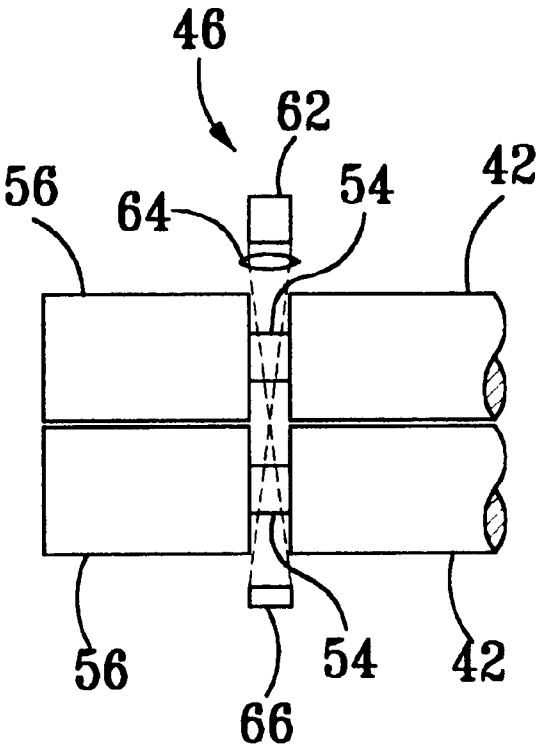
FIG. 4 is a front view of the two roller wheels shown in FIG. 3.
Figure 3:
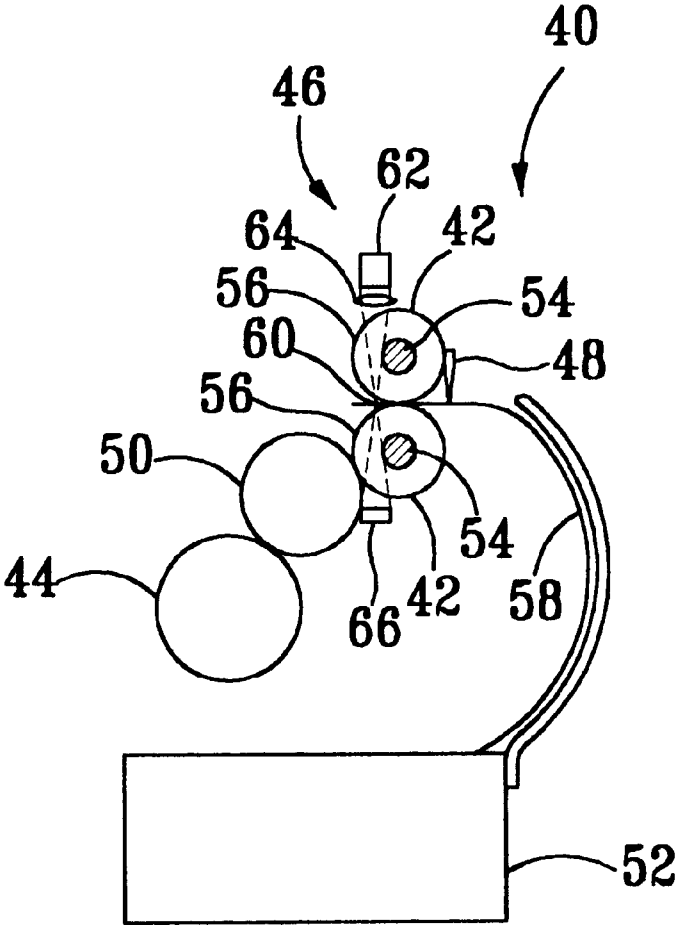
FIG. 3 is a structural diagram of part of a color printer according to the present invention.

Please refer to FIG. 3 and FIG. 4. FIG. 3 is a structural diagram of part of a color printer 40 according to the present invention. FIG. 4 is a front view of the two roller wheels 42 shown in FIG. 3. The printer 40 comprises two cylindrical roller wheels 42, a stepping motor 44, a detector 46, a printing head 48, a reduction gear 50, and a paper supplier 52. Each of the two roller wheels 42 comprises a cylindrical surface 56 which is in contact with each other for clamping and carrying a document 58 supplied by the document supplier 52. Each of the two roller wheels 42 also comprises a ring-shaped slot 54. The two ring-shaped slots 54 are linearly arranged. The reduction gear 50 is installed between the stepping motor 44 and the two roller wheels 42 so that the stepping motor 44 can drive the two roller wheels 42 forward and backward through the reduction gear 50. The detector 46 is installed at one side of the two roller wheels 42 for detecting a front edge 60 of the document 58 when the front edge 60 of the document 58 is carried forward through the two roller wheels 42. And the printing head 48 is installed at another side of the two roller wheels 42 for printing the document 58 after the detector 46 detects the front edge 60 of the document 58.

The detector 46 comprises a light source 62 for emitting light and a light detecting device 66 for detecting the light emitted from the light source 62. The two roller wheels 42 are in contact with each other and form a contact line and the detector 46 is positioned very close to the contact line of the two roller wheels 42 so as to accurately detect the front edge 60 of the document 58. If the detector 46 is not positioned so close to the contact line of the two roller wheels 42, the front edge 60 of the document 58 may become deformed when the front edge 60 passes through the contact line of the two roller wheels 42. Such deformation may cause inaccuracy in positioning the front edge 60 of the document 58. The two ring-shaped slots 54 over the two roller wheels 42 are designed for allowing the detector 46 get closer to the front edge 60 of the document 58 when it passes through the contact line of the two roller wheels 42. The light emitted from the light source 62 is directly transmitted to the light detecting device 66 through the two linearly arranged ring-shaped slots 54. The light source 62 further comprises a lens 64 for focusing the emitted light to detect the front edge 60 of the document 58 so that accuracy in positioning the front edge 60 of the document 58 can further be improved.

Figure 5:
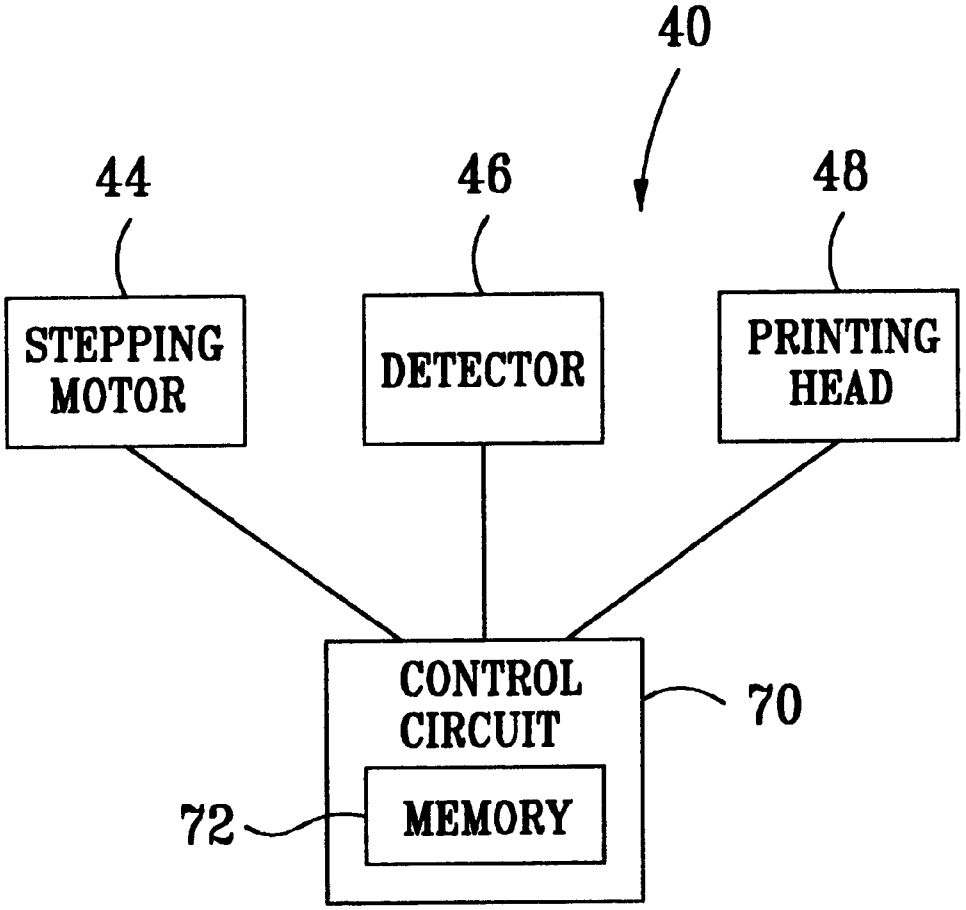
FIG. 5 is a function block diagram of the printer shown in FIG. 3.

Please refer to FIG. 5. FIG. 5 is a function block diagram of the printer 40 shown in FIG. 3. The printer 40 comprises a control circuit 70 for controlling operations of the printer 40. The control circuit 70 is connected to the stepping motor 44, detector 46 and printing head 48. The control circuit 70 comprises a memory 72 for recording the number of forward or backward steps of the stepping motor 44. When the front edge 60 of the document 58 reaches the focus of the light source 62, the light detecting device 66 will sense a substantive drop in light intensity and thus will accurately detect the front edge 60 of the document 58. The control circuit 70 will set an initial printing position in the memory 72 after detecting the front edge 60 of the document 58, and then activates the printing head 48 and stepping motor 44 to start one printing pass. After the first printing pass of the document 58 is finished, the control circuit 70 will activate the stepping motor 44 to drive the two roller wheels 42 backward a few steps more than the forward steps recorded in the memory 72 to ensure that the front edge 60 of the document 58 is away from the light detecting range of the detector 46. And then the control circuit 70 initiates another printing pass until all the colors are printed on the document 58.

The printing method of the color printer 40 in printing a color document 58 can be summarized below:

(1) using the stepping motor 44 to carry the document 58 forward and using the detector 46 to detect the front edge 60 of the document 58;

(2) calibrating the printing position recorded in the memory 72 when the detector 46 detects the front edge 60 of the document 58, calculating the number of forward steps of the stepping motor 44 after the front edge 60 of the document 58 is detected, and using the printing head 48 to print the document 58 according to the calculated forward steps until one pass of the printing is finished;

(3) carrying the document 58 backward a few steps more than the total forward steps recorded in the memory 72 to position the front edge 60 of the document 58 away from the detector 46; and (4) repeating from the step (1) to the step (3) until all passes of the printing are finished.

Comparing to the prior art color printer 10, the color printer 40 of the present invention provides the following three features to improve the accuracy in color printing. First, the roller wheels 42 of the color printer 40 comprise two ring-shaped slots 54 for immediately detecting the front edge 60 of the document 58 after it passes through the two roller wheels 42. Deformation over the front edge 60 is reduced almost to the minimum when it is detected by the detector 46 and thus the position of the front edge 60 can be very accurately detected. Second, the light source 62 of the detector 46 comprises a lens 64 for focusing the emitted light to the front edge 60 of the document 58 so that accuracy in detecting the front edge 60 of the document 58 is greatly enhanced. Third, the printing position recorded in the memory 72 is calibrated at the beginning of each printing pass so that the small displacements accumulated in a previous printing pass will be reset.

Those skilled in the art will readily observe that numerous modifications and alternations of the device may be made while retaining the teachings of the invention. Accordingly, the above disclosure should be constructed as limited only by the metes and bounds of the appended claims.

What is claimed is:

1. A printing method used by a printer for printing a document, the printer comprising:

two cylindrical roller wheels rotatably positioned together and in contact with each other for clamping and carrying the document forward and backward;

a stepping motor for driving the two roller wheels forward and backward;

a detector installed at one side of the two roller wheels for detecting a front edge of the document, the detector comprising a light source for emitting light and a light detecting device for detecting the light emitted from the light source, the light source further comprising a lens for focusing the emitted light on the passage of the document; wherein when the front edge of the document passes through the focus of the emitted light, the light received by the light detecting device will be substantially reduced so that the front edge of the document can be immediately and accurately detected;

a printing head installed at another side of the two roller wheels for printing the document; and a control circuit connected to the stepping motor, detector and printing head for controlling operations of the printer;

the printing method comprising the following steps:

(1) using the stepping motor to carry the document forward and using the detector to detect the front edge of the document;

(2) calculating the number of forward steps of the stepping motor after the front edge of the document is detected and using the printing head to print the document according to the calculated forward steps until one pass of the printing is finished;

(3) carrying the document backward to move the front edge of the document away from the detector; and (4) repeating from the step (1) to the step (3) until all passes of the printing are finished.

2. The printing method of claim 1 wherein the printer further comprises a reduction gear installed between the stepping motor and the two roller wheels so that the stepping motor can drive the two roller wheels forward or backward through the reduction gear.

3. The printing method of claim 1 wherein each of the two roller wheels comprises a ring-shaped slot and the two ring-shaped slots are linearly arranged wherein the light emitted from the light source is transmitted to the light detecting device through the two ring-shaped slots.

4. The printing method of claim 1 wherein the two roller wheels are in contact with each other and form a contact line wherein the detector is positioned very close to the contact line of the two roller wheels so as to accurately detect the front edge of the document.

5. The printing method of claim 1 wherein the printer is a color printer and each pass of the printing method is used for printing one color to the document.

6. A printer for printing a document comprising:

two cylindrical roller wheels rotatably positioned together and in contact with each other for clamping and carrying the document;

a stepping motor for driving the two roller wheels;

a detector installed at one side of the two roller wheels for detecting a front edge of the document when the front edge of the document is carried forward through the two roller wheels, the detector comprising a light source for emitting light and a light detecting device for detecting the light emitted from the light source;

a printing head installed at another side of the two roller wheels for printing the document; and a control circuit connected to the stepping motor, detector and printing head for controlling operations of the printer;

wherein each of the two roller wheels comprises a ring-shaped slot and the two ring-shaped slots are linearly arranged so that the light emitted from the light source is transmitted to the light detecting device through the two ring-shaped slots.

7. The printing method of claim 6 wherein the two roller wheels are in contact with each other and form a contact line wherein the detector is positioned very close to the contact line of the two roller wheels so as to accurately detect the front edge of the document.

8. The printer of claim 6 wherein the light source further comprises a lens for focusing the emitted light to detect the front edge of the document.

9. The printing method of claim 8 wherein when the front edge of the document passes through the focus of the emitted light, the light received by the light detecting device will be substantially reduced so that the front edge of the document can be immediately detected.

10. A printer for printing a document comprising:

two cylindrical roller wheels being in contact with each other and forming a contact line for clamping and carrying the document;

a stepping motor for driving the two roller wheels;

a detector installed at one side of the two roller wheels for detecting the front edge of the document when the front edge of the document is carried forward through the two roller wheels, the detector comprising a light source for emitting light and a light detecting device for detecting the light emitted from the light source;

a printing head installed at another side of the two roller wheels for printing the document; and a control circuit connected to the stepping motor, detector and printing head for controlling operations of the printer;

wherein the light source further comprises a lens for focusing the emitted light on the passage of the document and when the front edge of the document passes through the focus of the emitted light, the light received by the light detecting device will be substantially reduced so that the front edge of the document can be immediately and accurately detected.

11. The printing method of claim 10 wherein the two roller wheels are in contact with each other and form a contact line wherein the detector is positioned very close to the contact line of the two roller wheels so as to accurately detect the front edge of the document.

* * * * *

UNITED STATES PATENT AND TRADEMARK OFFICE

CERTIFICATE OF CORRECTION

PATENT NO. : 6,074,114
APPLICATION NO. : 09/005557
DATED : June 13, 2000
INVENTOR(S) : Chi-Ming Chien and Ming-Huang Shih It is certified that error appears in the above-identified patent and that said Letters Patent is hereby corrected as shown below:

On the cover of U.S. Patent No. 6,074,114, the inventor names should be "Chi-Ming Chien" and "Ming-Huang Shih." The inventor names were improperly printed as "Chien Chi Ming" and "Shih Ming-Huang" due to a translational error.

Signed and Sealed this

Thirty-first Day of March, 2009

John Doll

JOHN DOLL
*Acting Director of the United States Patent and Trademark Office*